US005101985A

United States Patent [19]

Pasban-Dowlatshahi

[11] Patent Number: 5,101,985

[45] Date of Patent: Apr. 7, 1992

[54] DEVICES FOR SUPPORTING SADDLES

[76] Inventor: Vivi Pasban-Dowlatshahi, Graham Lodge, East Street, Bookham, Surrey, KT23 4QU, United Kingdom

[21] Appl. No.: 599,093

[22] Filed: Oct. 17, 1990

[30] Foreign Application Priority Data

Oct. 18, 1989 [GB] United Kingdom ..... 8923438
Feb. 16, 1990 [GB] United Kingdom ..... 9003565

[51] Int. Cl.[5] ..... A47F 7/00
[52] U.S. Cl. ..... 211/13; 211/87
[58] Field of Search ..... 211/87, 86, 13, 4, 113, 211/118; 248/317, 551, 552

[56] References Cited

U.S. PATENT DOCUMENTS

| | | | |
|---|---|---|---|
| 1,027,672 | 5/1912 | Sime | 248/317 X |
| 2,760,746 | 8/1956 | Botolfsen | 211/13 X |
| 3,288,417 | 11/1966 | Wallace | 248/317 |
| 3,305,101 | 2/1967 | Mills | 211/13 X |
| 3,811,574 | 5/1974 | O'Brien | 211/13 |
| 3,901,165 | 8/1975 | Schlesinger | 211/113 X |
| 4,025,014 | 5/1977 | Larson | 248/552 |
| 4,078,753 | 3/1978 | Cole | 248/317 X |
| 4,805,782 | 2/1989 | Hale et al. | 211/113 X |

FOREIGN PATENT DOCUMENTS

| | | | |
|---|---|---|---|
| 977279 | 11/1950 | France | 248/317 |

*Primary Examiner*—Robert W. Gibson, Jr.
*Attorney, Agent, or Firm*—Banner, Birch, McKie & Beckett

[57] ABSTRACT

A transportable saddle hanger comprising a saddle suspending member to extend along the underside of the saddle when the hanger is in use, connecting means at or adjacent to one end of the saddle suspending member to enable the hanger to be removably connected to any suitable form of hook or the like support, e.g. on a wall and an end plate at or adjacent to the other end of the saddle suspending member and adapted to be disposed under and against the pommel of the saddle when the saddle hanger is in use.

10 Claims, 7 Drawing Sheets

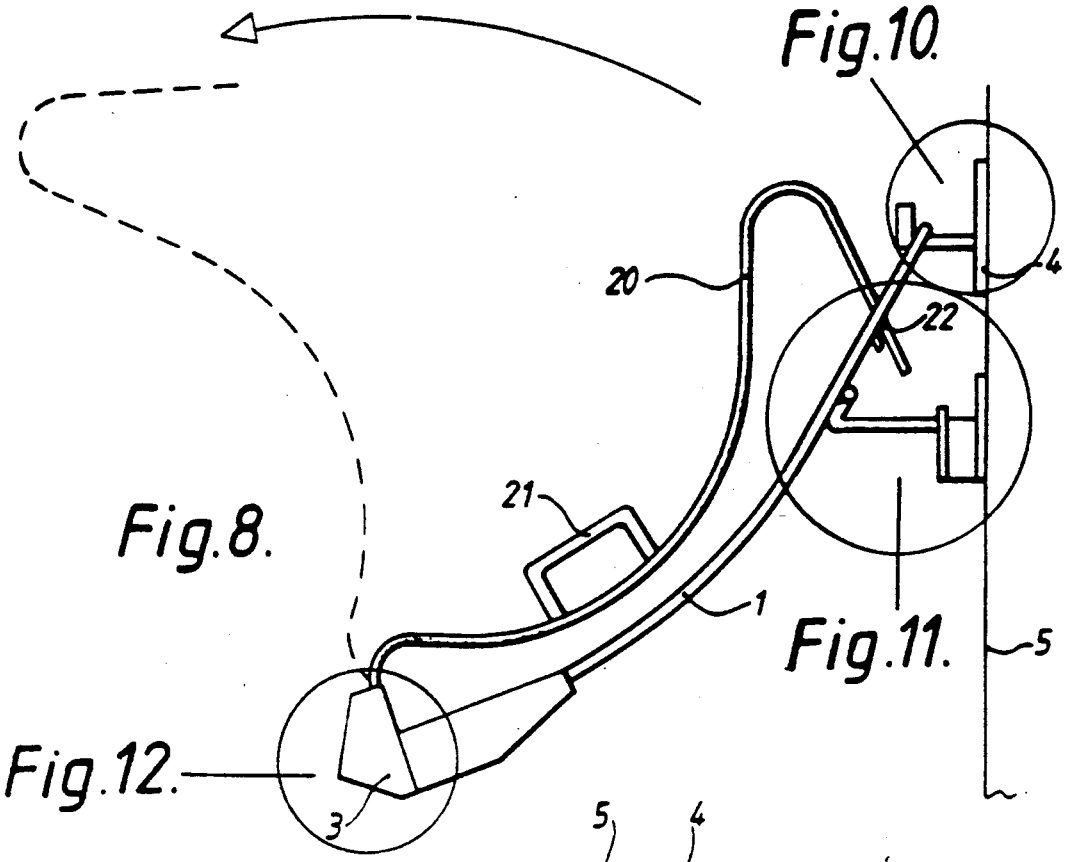
Fig.10.
20
4
22
21
Fig.8.
1
Fig.11.
5
Fig.12.
3
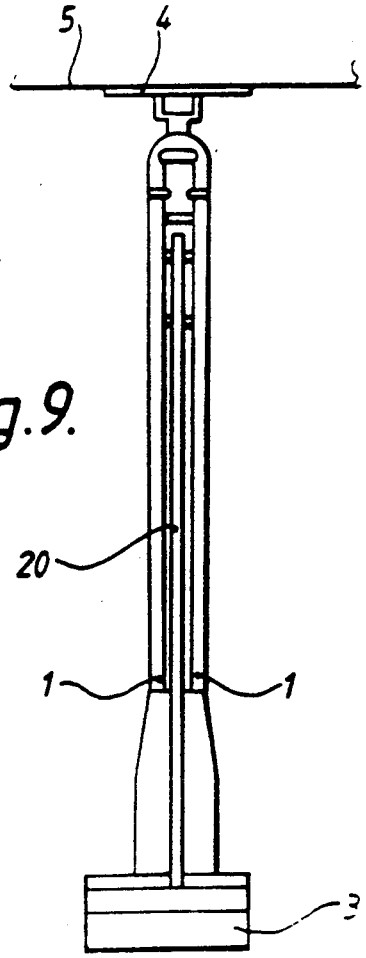
5
4
Fig.9.
20
1
1
3

DEVICES FOR SUPPORTING SADDLES

This invention is concerned with the provision of a new and improved saddle hanger.

When not in use riding saddles are conventionally hung on the wall in what is called the tack room. For this purpose it is the normal practice to provide a specially designed metal saddle rack which is firmly secured to the wall of the tack room with the rack projecting outwardly more or less horizontally from the wall.

After riding, a rider can unsaddle the animal and can hang the saddle on the saddle rack. Known saddle racks are effective but have one or two disadvantages. In the first place known saddle racks are relatively large and are fixed to the wall so that they project a considerable way into the room and may create a hazard for the unwary. Secondly known saddle racks are immovable in the sense that they are fixed to a wall. That is a disadvantage because it is often necessary to transport an animal for riding from the stable to the riding area. That is usually done in a horse box/trailer in which case it is necessary to provide another saddle rack in the horse box/trailer.

It is the main object of the present invention to provide a simple relatively inexpensive, saddle hanger that can travel with the animal.

According to the present invention there is provided a saddle hanger comprising a saddle suspending member to extend along the underside of the saddle when the hanger is in use, connecting means at or adjacent to one end of the saddle suspending member to enable the hanger to be removably connected to any suitable form of hook or like support e.g. on a wall or ceiling and an end plate at or adjacent to the other end of the saddle suspending member and adapted to be disposed under and behind the pommel of the saddle when the saddle hanger is in use. The end plate may be shaped to fit or match the contours of the pommel of the saddle and the end plate preferably incorporates a support plate which is shaped to fit the saddle and which extends along the tree on the underside of the saddle to give firm support to the saddle.

In accordance with one aspect of the invention the saddle suspending member may be a flexible connector such as a length of cord or the like, as herein defined, the saddle hanger being adapted to suspend a saddle in an inclined position with the end plate under and behind the pommel and the cord passing under the saddle along the tree to the hook which may conveniently be fixed to a wall/ceiling.

It will be understood from the above that when in use the connecting means will be at the upper end of the saddle hanger and the end plate will be at the lower end so that the main function of the end plate is to prevent the saddle slipping down off the saddle hanger. The end plate may simply be of square, round or rectangular or other simple section but the end plate may be specially shaped to fit the contours of the end of the saddle.

In this specification the word cord is used in a broad sense to include any suitable length of flexible material, capable of forming a saddle suspending member, for a saddle, such as a rope, nylon thread, strong twine, wire, a strap, tape or the like.

The end plate is preferably fixedly attached to the saddle suspending member and may be made of any suitable material such as wood, metal, leather or plastics material, e.g. nylon.

In accordance with another or second aspect of the present invention the saddle hanger may comprise a rigid or substantially rigid saddle suspending member in the form of a suspending arm consisting of a rod or rods or a bar or the like such as a gently curved metal bar or a bar of plastics material, means at or adjacent to one end of the suspending arm to enable the hanger to be connected to any suitable form of hook or like support e.g. on a wall and an end plate provided on the suspending arm at or adjacent to the other end of the suspending arm, the saddle hanger being adapted to suspend the saddle in an inclined position with the end plate under and behind the pommel and the suspending arm passing under the saddle to the hook or the like, the end plate being of simple section or being suitably shaped to fit against the pommel and preferably having a support plate to fit under the front of the saddle below the tree when the saddle hanger is in use so that the saddle really rests on the end plate and is supported by the support plate.

The second aspect of the present invention provides a more rigid and stronger structure than that described in relation to the first aspect of the invention and one advantage of using a rigid or semi-rigid saddle suspending member is that locking means may more easily be provided to minimise the risk of a saddle being removed from the saddle hanger by an unauthorised person. In accordance with this feature of the invention I may provide a locking arm pivotally connected to the end plate so that the locking arm may be closed down over a saddle when in position on the saddle suspending member and the locking arm may be locked in position in any suitable way, e.g. by a padlock and chain.

A saddle hanger in accordance with this invention is simple and may be inexpensive and it is transportable in the sense that it can easily be taken from place to place. All that is required in the tack room or in the horsebox/trailer is any simple known form of hook on the wall or the ceiling on which to hang the saddle hanger so that when the saddle is in use the wall is not encumbered with large projecting racks.

If desired the end plate may include letter press in the form of a message such as the name of a horse, a riding team or a rider and/or may bear the colours of a particular rider or owner.

When using the new saddle hanger the saddle suspending member may first be hung on a suitable hook attached to a wall e.g. by engaging a loop at the upper end of the suspending member with the hook so that the suspending member hangs down either more or less parallel to the wall if the suspending member is a flexible cord or inclined somewhat away from the wall if the suspending member is a more rigid structure. The lower end of the suspending member may then be lifted manually away from the wall and the saddle may be gently applied to or placed upon the suspending member in such a position that the suspending member extends along the underside of the saddle and the pommel rests against the end plate. The suspending member may then be released gently so that when using a flexible suspending member the rear lower end of each side of the saddle rests squarely against the wall. If desired a bridle support may be provided in combination with the saddle hanger.

In order that the invention may be more clearly understood reference is now directed to the accompanying drawings given by way of example in which:

FIG. 8 is a side elevation of a second more rigid embodiment of the invention, including a locking arm with the saddle hanger in its operable position, the saddle being omitted for the sake of clarity.

FIG. 9 is a plan view of the saddle hanger shown in FIG. 8,

Figure 10:
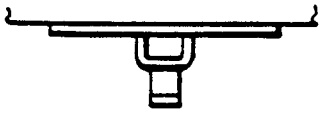
Figure 11:
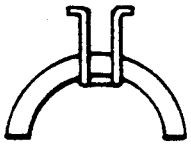
Figure 13:
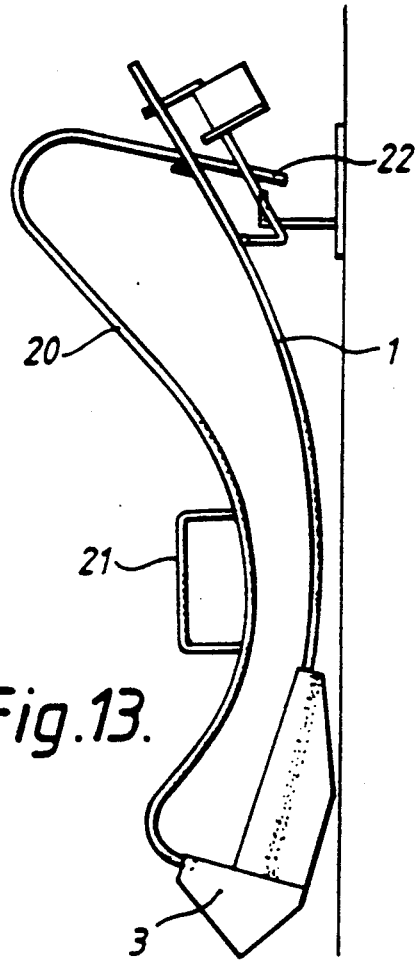
Figure 12:
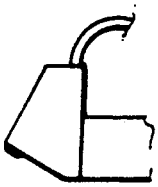
Figure 14:
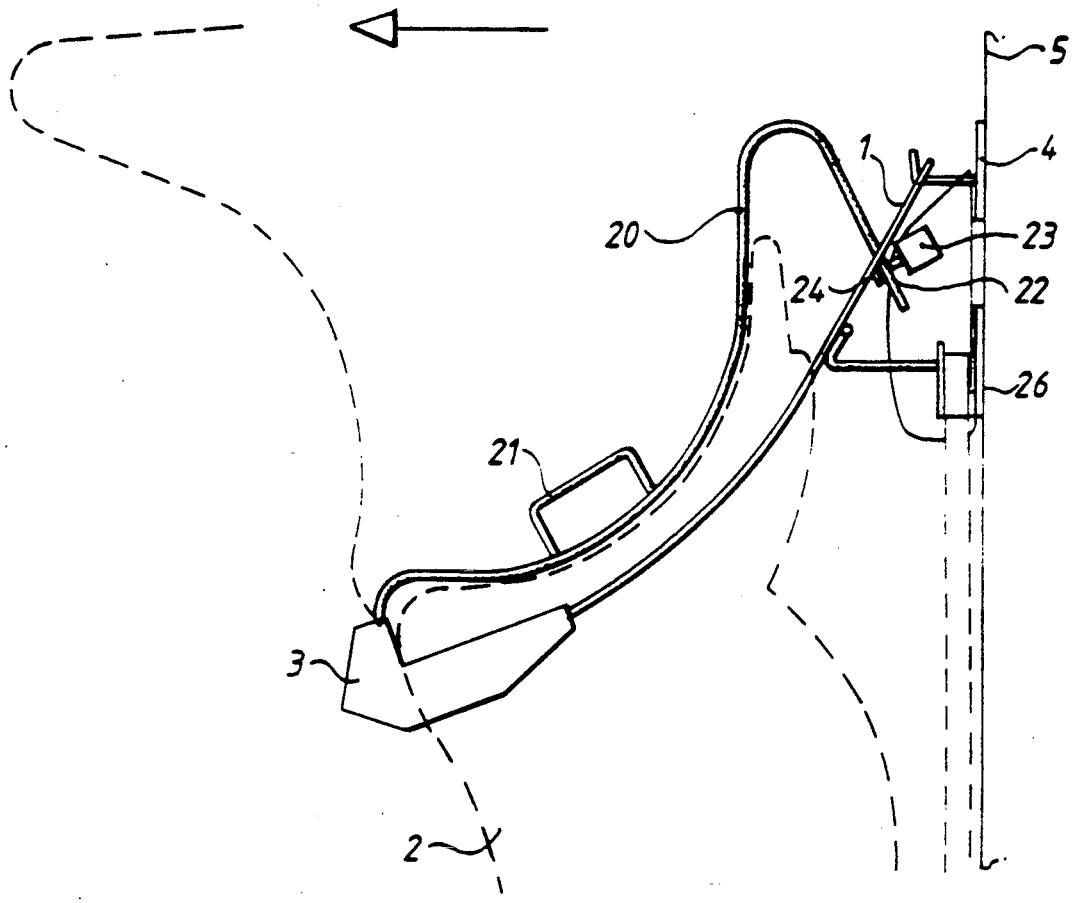
Figure 15:
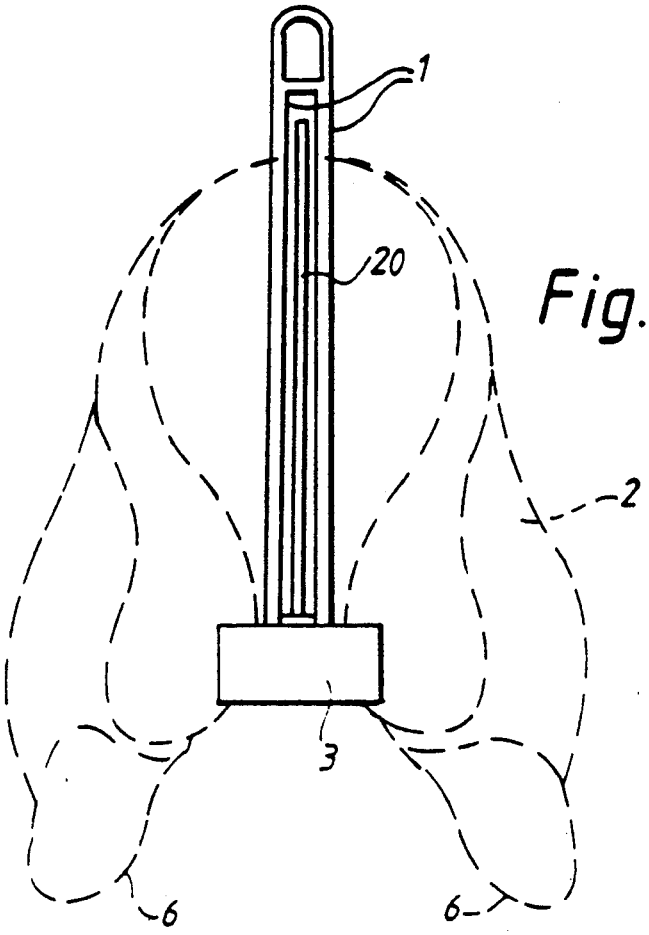
Figure 16:
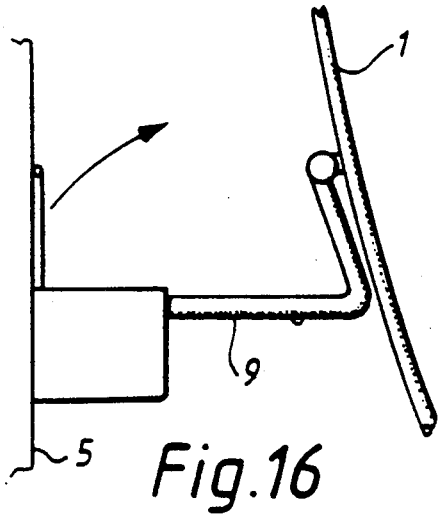
Figure 16A:
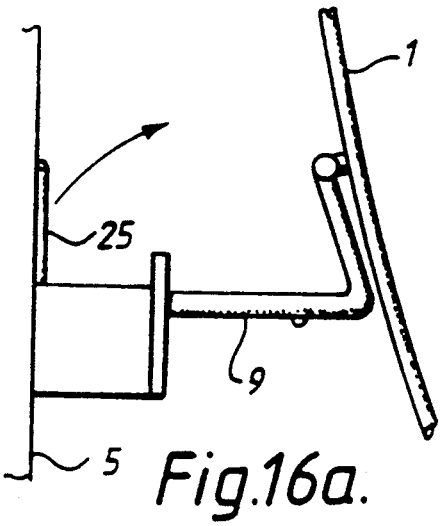
Figure 17:
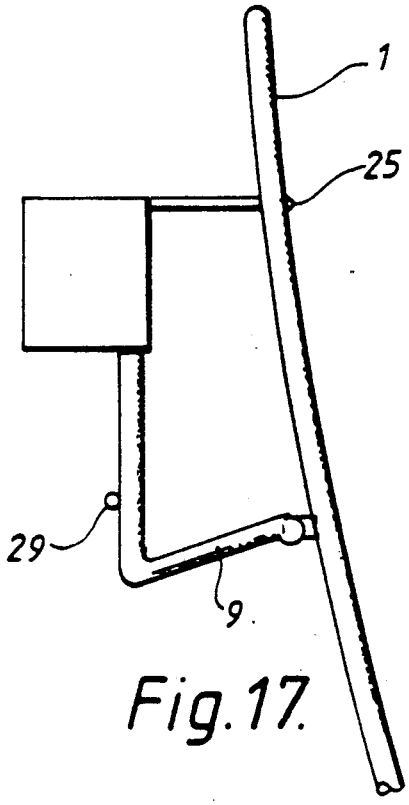
Figure 18:
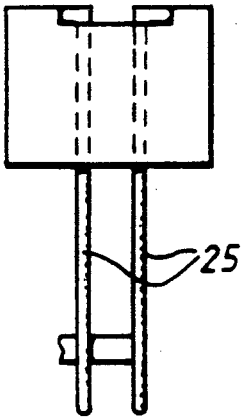
Figure 19:
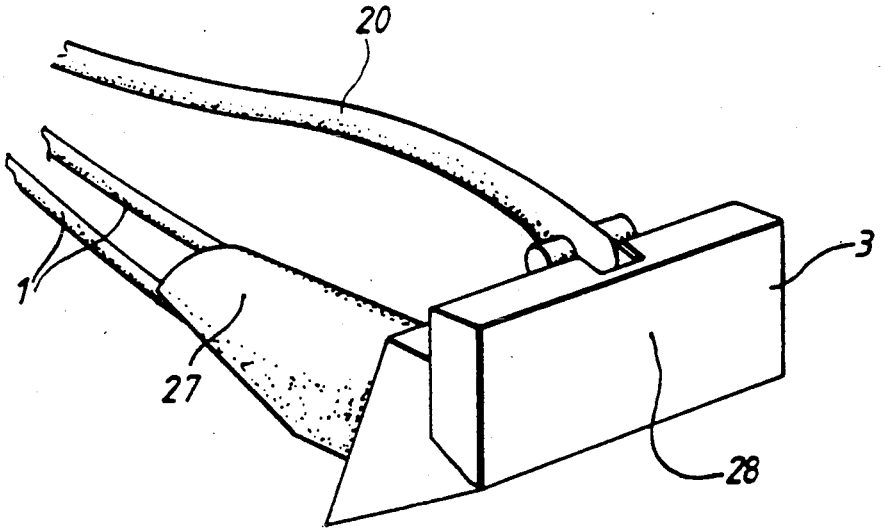

FIGS. 10, 11 and 12 are detail views of FIG. 8, FIG. 10 being a plan, FIG. 11 being a front view and FIG. 12 being a side view, drawn to an enlarged scale, FIG. 13 is a side elevation of the hanger in its inoperative position, FIGS. 14 are 15 are respectively a side elevation and plan of the hanger with the saddle in dash lines, and FIGS. 16, 16A, 17, 18 and 19 are detail views to an enlarged scale, FIG. 16 showing the bridle support resting against the wall, FIG. 16A showing a modification, FIG. 17 showing the bridle support in its inoperative position, FIG. 18 being a plan view of the end of the bridle support and FIG. 19 being a perspective view of one form of end plate with a support plate to fit under the saddle.

Referring to the FIGS. 1 to 7A of the drawings and especially to FIGS. 1, 2 and 3, a saddle hanger according to this invention comprises a saddle suspending member 1 in the form of a cord to which a saddle 2 may be applied, and an end plate 3 which, in use, is disposed below the pommel of the saddle 2, i.e. under the front of the saddle below the tree. Looking particularly at the side view, FIG. 2, it will be noted that the saddle hanger cord is supported by a hook 4 mounted on a wall 5, the cord then extends away from the wall at an angle and passes under the saddle 2 with the end plate 3 behind the pommel of the saddle to prevent the saddle from sliding off the cord. When in position the rear lower end 6 of each side of the saddle rests squarely against the wall 5. The hook 4 may be secured to the wall 5 in such a position that the saddle 2 may hang at a high level or the hook may be positioned so that the saddle hangs at low level. In other words a hook 4 can be secured in any desired position to suit the rider, FIG. 4 shows the saddle hanger suspended from a hook 4 connected to a ceiling 7. When suspended from a ceiling 7 the cord may be passed through a D or other ring 8 on the saddle 2 and is then passed down the underside of the saddle so that the end plate 3 rests under the pommel. Reference 3*a* indicates a support plate under the tree of the saddle.

Figure 5:
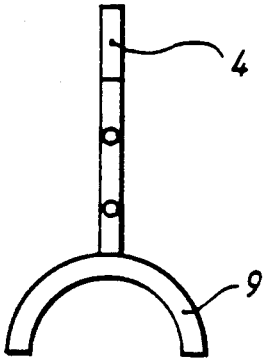
FIG. 5 shows the use of a hook incorporating a bridle support.
Figure 6:
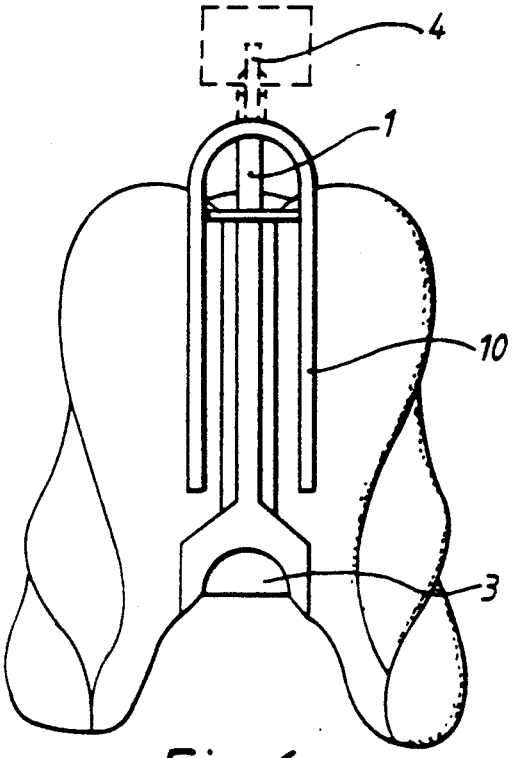
FIG. 6 shows how the bridle support can be used with the bridle handing down.
Figure 7:
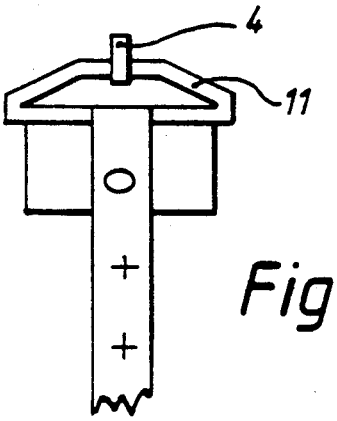
FIG. 7 is a detail view showing the use of a ring on the hook.

FIG. 5 shows a bridle support 9 for use with the saddle hanger connected to, associated with or forming part of a hook 4. The bridle support 9 has a curved upper surface, so that it is of inverted U shape, to support the bridle which may hang over the support. FIG. 6 shows how the bridle support can be used with a bridle 10 hanging down from the bridle support behind the saddle i.e. between the saddle and the wall. The bridle support 9 may be a separate fitment adapted to hang from the hook or may be an integral part of a specially designed hook or may be formed as a part of the saddle hanger by being connected to the upper part of the saddle suspending member 1. Means may be provided to enable the length of the saddle suspending member 1 to be adjusted e.g. by providing a cord in the form of a strap with spaced apart holes so that two or more holes can be tied together to shorten the cord. As an alternative a clip may be provided to form a loop in the cord in order to reduce its length.

The end plate 3 may be provided with a support plate shaped to fit the contours of the underside of the saddle, the support plate being shaped to follow the 'tree' of the saddle at the front and towards the middle. The end plate 3 therefore may not only support the front end of the saddle but also may extend under the saddle to form a support plate. An end plate incorporating a support plate under the saddle is preferably formed as a unitary structure.

If desired the support plate can extend upwardly along a substantial part of the underside of the saddle and in some cases, especially when used with a very expensive saddle may be shaped to support most or even all of the underside of the saddle so that the saddle is more or less sitting on the support plate. The upper end of the cord may be provided with a ring member or D shaped member 11 which, when the hanger is in use, is supported by the hook. A transversely extending cross-member may be provided to give greater stability to the saddle when the hanger is in use. The cross-member may be provided by widening the base of the member 11 and likewise the cord may be made wider to fit the wider base of the member 11, see FIG. 7.

Figure 1:
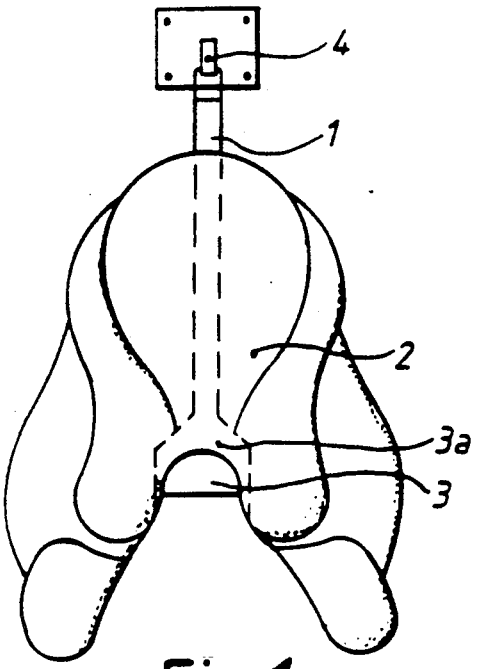
FIG. 1 is a front elevation of a saddle hanger incorporating flexible suspending member in accordance with the invention with a saddle in position on the hanger.
Figure 2:
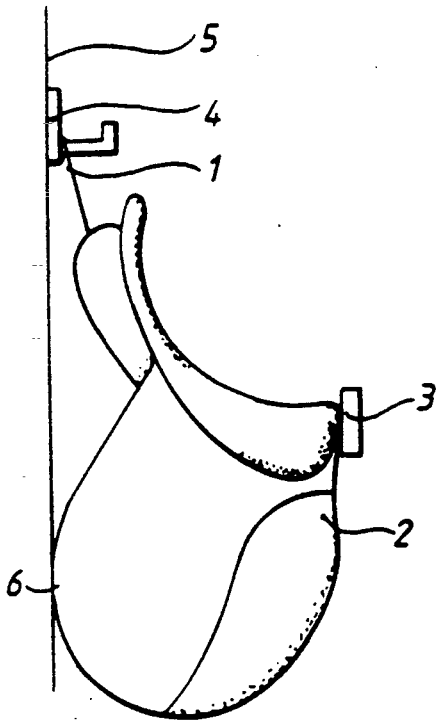
FIG. 2 is a side view of the saddle hanger shown in FIG. 1.
Figure 3:
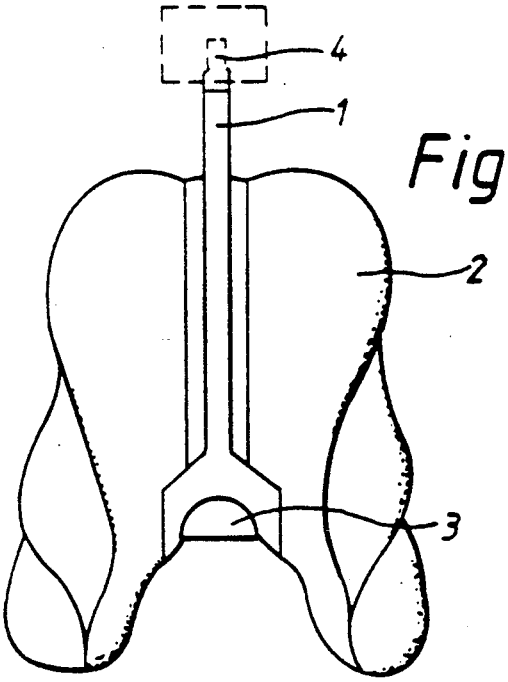
FIG. 3 is a rear view of the saddle hanger shown in FIG. 1.
Figure 4:
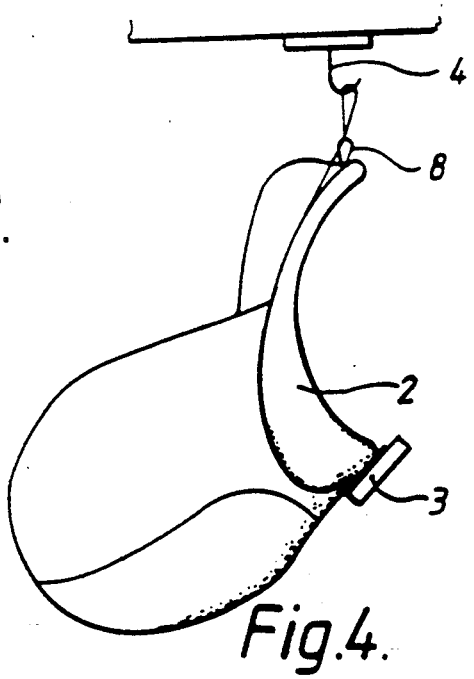
FIG. 4 shows how a saddle hanger according to this invention may be suspended from a ceiling.

It will be understood from the above that the basic principle or underlying idea of the invention is shown in FIGS. 1, 2 and 3 and comprises a member, in the form of the end plate, resting against the front of the saddle i.e. the pommel. To help the saddle to retain its shape when the saddle is not in use the end plate may as described above be provided with or shaped to provide a support plate so that the end plate 3 holds the saddle in position on the hanger and the support plate provides support under the saddle. In this embodiment of the invention the end plate and the support plate are connected to the cord which is preferably sufficiently wide to fit along the width of the tree of the saddle. The saddle hanger may therefore have simply an end plate larger than the pommel of the saddle to prevent the saddle from slipping off the cord or may include a support plate shaped to be disposed under part or all of the tree of the saddle, the support plate being shaped to match and conform to the contours of the underside of the saddle. The larger the size of the support plate the better will be the support given to the saddle.

In some cases it may be an advantage to make the new saddle hanger as a more rigid structure than that described above. Therefore in accordance with this aspect of the present invention, I may provide a saddle hanger comprising a rigid or substantially rigid saddle suspending member 1 in the form of a suspending arm consisting of a rod or rods or a bar or the like such as a gently curved metal or platics bar, means at or adjacent to one end of the saddle suspending member 1 to enable the saddle hanger to be connected to any suitable form of hook 4 or the like, e.g. on a wall 5 and an end plate 3 provided on the suspending member 1 at or adjacent to the other end of the suspending member 1 and adapted to suspend a saddle 2 in an inclined position with the end plate 3 under and behind the pommel and the suspending member passing under the saddle to the hook 4 or the like. The end plate may be suitably shaped to fit the pommel.

One advantage of using a rigid or substantially rigid suspending member 1 is that locking means may easily be provided to minimise the risk of a saddle being removed from the saddle hanger by an unauthorised person. In accordance with this feature of the invention I may provide a locking arm pivotally connected to the end plate so that the locking arm may be closed down over a saddle when in position on the suspending member and the locking arm may be locked in position in any suitable way e.g. by a padlock and chain.

Referring now to FIGS. 8 to 19 in detail a saddle hanger according to the second aspect of the invention comprises a suspending member 1 in the form of a suspending arm made of rigid or substantially rigid material such as metal or a strong moulded plastics material on which a saddle 2 may be suspended. The suspending arm is provided with an end plate 3 which, in use, is disposed below the pommel of the saddle 2. Looking particularly at the side views e.g. FIG. 8, it will be noted that the suspending arm is suspended from a hook 4 mounted on a wall 5, the suspending arm then extends away from the wall 5 at an angle and passes under the saddle 2 with the end plate 3 behind the pommel of the saddle 2 to prevent the saddle from sliding off the suspending arm. A bridle support 9 rests against the wall see FIGS. 16 and 16A and holds the saddle away from contact with the wall as hereinafter more fully described.

Preferably a specially shaped hook 4 with an aperture therein is used, see FIG. 10, in order to facilitate locking. As in the first embodiment when the saddle hanger is suspended from a ceiling the suspending arm may be passed through a D or other ring on the saddle 2, then passed down the underside of the saddle so that the end plate rests under the pommel.

In order to secure the saddle 2 in position on the hanger a locking arm 20 is provided. The locking arm 20 is pivotally connected to the end plate 3 as shown e.g. in FIG. 8. The suspending arm is gently concave in shape on its upper side and the locking arm 20 is also concave and is spaced therefrom so as to leave a gap between the locking arm 20 and the suspending arm to receive the saddle when the hanger is in use. The locking arm 20 has a handle 21 by means of which the hanger may be carried and at the upper end the locking arm 20 is turned inwards towards the suspending arm 1 and terminates in a securing portion 22 which is provided with several holes, for use when it is desired to lock a saddle in position on the saddle hanger. The securing portion 22 is passed through an opening in the suspending arm and may be secured in position by passing the prong of a padlock through the appropriate hole. The securing portion 22 of the locking arm 20 has several holes so that the space between the locking arm 20 and the suspending arm may be selected to suit the size of the saddle. The padlock may have a chain shown at 23 which can be used for locking the locking arm 20 in position and for locking the saddle hanger to the wall or ceiling or to some other fixture. For example the padlock prong may be threaded through a fixed locking fitment with an eye or opening then through the selected hole in the securing portion of the locking arm 20 and the chain may extend through the opening in the hook and back to the padlock. Any other suitable means of locking the locking arm 20 to prevent removal of the saddle may be used. Instead of locking the locking arm means may be provided to permit the locking arm to be latched or otherwise secured in position without locking. The suspending arm, see e.g. FIGS. 16A, 17 and 18, is provided with a bridle support 9 hingedly secured to the back of the suspending arm. When in use and on a wall the bridle support has an inclined portion hinged to the suspending arm see FIG. 16 and resting against the back of the said arm, a horizontal portion on which the rider's equipment 26 may be hung and a vertical portion which rests against the wall and serves to assist the bridle support in keeping the saddle hanger in position. When the saddle hanger is not in use the bridle support may be hinged into the position shown e.g. in FIG. 17 in which a pair of spring rods 25 forming the end of the bridle support 9, see FIG. 18 are passed through the suspending arm. The springy nature of the rods 25 and the shape of the support 9 causes the support 9 to be retained in the position shown in FIG. 17 until the saddle hanger is required for use again at which time, with minimum force, the bridle support can be swung back into the position shown in FIG. 16. A bar 29 is provided to support the saddle hanger. As shown in FIG. 19 the end plate rests against the pommel of the saddle and is provided with a support plate which extends up under the saddle and which is shaped to fit the underside of the saddle. The end plate illustrated is made of plate metal bent to the required shape including a substantially rectangular box-like rear part 28, and a saddle shaped support plate in the form of an extension 27 to fit under the saddle below the tree. The precise form of end plate illustrated is a preferred form but essentially all that is required is an end plate to rest against the pommel to prevent the saddle sliding off the hanger. The locking arm 20 is pivoted to the top of the end plate 3 and the suspending arm, which in the illustrated embodiment is in the form of two spaced apart parallel rods or may be rods slightly tapered towards the top, is connected to the end plate adjacent to the bottom.

It will be understood that a saddle hanger in accordance with this aspect of the invention using a rigid or semi-rigid suspending arm may be provided with or without a locking arm 20 and may have simply an end plate or may have an end plate with a support plate to fit under the saddle.

In a modification see FIG. 16A, the bridle support may have a saddle shaped portion on which the bridle and other equipment may be hung and which is extended back to contact the wall. A lip may be provided at the outer end of the bridle support to retain the equipment in position. The bridle support preferably has two rods and so holes or a cut out may be made in the support portion to allow the vertical part of each rod to pass through.

I claim:

1. A transportable saddle hanger comprising a saddle suspending member to extend along the underside of the saddle when the hanger is in use, connecting means at or adjacent to one end of the saddle suspending member to enable the hanger to be removably connected to any suitable form of hook and an end plate at or adjacent to the other end of the saddle suspending member and adapted to be disposed under and against the pommel of the saddle when the saddle hanger is in use, wherein the saddle suspending member is a flexible connector such as a length of cord.

2. A transportable saddle hanger comprising a rigid or substantially rigid saddle suspending member, means at or adjacent to the upper end of the suspending member to enable the saddle hanger to be removably connected to any suitable form of hook, an end plate provided on the suspending member at or adjacent to the lower end thereof, a support plate shaped to fit the contours of the underside of a saddle in order to support at least the front part of the saddle and a concave locking arm pivotally connected to the end plate so that the locking arm may be closed down over the saddle when it is in position on the saddle hanger and the saddle may thereby be locked in that position, the saddle hanger being adapted to suspend the saddle with the end plate below the pommel to prevent the saddle sliding off the hanger and with the support plate under the tree of the saddle to support the saddle.

3. A saddle hanger according to claim 1 or 2, wherein the end plate is suitably shaped to fit against the pommel.

4. A saddle hanger according to claim 1 wherein the end plate includes a support plate shaped to fit under the saddle.

5. A saddle hanger according to claim 2 wherein the suspending member consists of a rod or rods, or a bar such as a gently curved metal bar.

6. A saddle hanger claim 2 wherein a bridle support is provided for use with the saddle hanger.

7. A saddle hanger according to claim 2 or 4 wherein the support plate is shaped to follow the tree of the saddle at the front end towards the middle and may extend upwardly along a substantial part of the underside of the saddle.

8. A saddle hanger according to claim 6 wherein the bridle support is hinged to the back of the suspending member and is shaped so that a part of the bridle support rests against the wall when the saddle hanger is in operative position on a wall and the bridle support may be hingedly moved into an inoperative position when the saddle hanger is not in use.

9. A saddle hanger according to claim 2 including a handle on the locking arm by means of which the saddle hanger may be carried.

10. A saddle hanger according to claim 1 wherein a bridle support is provided for use with the saddle hanger.

* * * * *